United States Patent [19]

Gould

[11] 4,254,391

[45] Mar. 3, 1981

[54] SPLIT ARMATURE RELAY

[75] Inventor: Richard E. Gould, Shelby, N.C.

[73] Assignee: Fasco Industries, Inc., Boca Raton, Fla.

[21] Appl. No.: 76,249

[22] Filed: Sep. 17, 1979

[51] Int. Cl.[3] ..... H01H 67/02

[52] U.S. Cl. ..... 335/119; 335/120; 335/202

[58] Field of Search ..... 335/121, 124, 127, 128, 335/129, 270, 276, 279, 119, 120, 202

[56] References Cited

U.S. PATENT DOCUMENTS

| | | | |
|---|---|---|---|
| 1,876,295 | 9/1932 | Hofgaard | 335/119 |
| 2,261,887 | 11/1941 | Menzel | 335/119 X |

FOREIGN PATENT DOCUMENTS

| | | | |
|---|---|---|---|
| 475961 | 11/1952 | Italy | 335/119 |

*Primary Examiner*—George Harris

*Attorney, Agent, or Firm*—Shlesinger, Fitzsimmons & Shlesinger

[57] ABSTRACT

A relay coil is fixed in a housing adjacent a pair of vertically spaced, stationary contacts, which are electrically insulated from one another, and which have associated terminals that project exteriorly of the housing. A pair of resilient switch arms project from a stationary metal plate in the housing transversely across one end of the armature coil in spaced, parallel relation to each other. At their ends remote from the metal plate the switch arms carry a pair of contacts which register with the stationary contacts in the housing. An armature member is secured to and extends along the inside surface of each switch arm in confronting relation to the adjacent end of the armature coil. Curved, resilient portions of the switch arms adjacent the metal mounting plate normally hold the arms resiliently in switch-open positions, but when the armature coil is energized the two armatures are drawn toward the coil, thus pivoting the spring arms into positions in which their contacts engage the stationary contacts to close the circuit. Both the armatures and the switch arms are capable of moving independently of one another.

10 Claims, 5 Drawing Figures

SPLIT ARMATURE RELAY

This invention relates to switching relays, and more particularly to an improved relay of the double make-double break variety. Even more particularly this invention relates to a novel relay which utilizes a split or two-piece armature for actuating two make or break switch contacts.

Most relays utilize a single, hinged or pivoted armature to which a movable switch contact is attached for direct operation by the armature. When the armature is pivoted by energization (or deenergization) of the associated relay coil, the attached switch contact is moved either to make or break a circuit. One major disadvantage of this type of relay is that, if for some reason the movable switch contact should weld or otherwise become stuck closed, it may fail to open upon the deenergization of the associated relay coil.

It is old in the art to operate a plurality of movable switch arms or contacts by means of a single relay coil. This is usually effected by a single armature which is attached to a reciprocable contact carrier. However, it is the carrier itself, which moves a plurality of contacts simultaneously into or out of engagement with a corresponding plurality of stationary contacts, as disclosed for example in U.S. Pat. No. 3,815,060. Alternatively the single armature may carry a cross member which reciprocates to effect simultaneous opening or closing of a plurality of switch contact arms as taught in U.S. Pat. No. 2,951,922. Moreover, even in the case of the construction disclosed in U.S. Pat. No. 2,892,058, wherein a split armature is employed, the two armatures are interconnected by a single spool member which effectively transmits the movement of one armature to the other, so that as a practical matter neither the two armatures nor the associated switch contacts are capable of operating independently of one another.

It is an object of this invention, therefore, to provide an improved relay having a split armature portions of which operate two switch contacts that are capable of moving independently of one another.

Another object of this invention is to provide an improved armature of the type described which utilizes a single coil and two separate armatures for simultaneously opening or closing two associated switch contacts that are connected in series, thereby providing a more reliable relay.

A further object of this invention is to provide an improved double make-double break relay which is substantially more compact and inexpensive to manufacture than relays of similar function.

Still a further object of this invention is to provide a relay of the type described in which two separate armatures are operated by a single relay coil to effect simultaneous making or breaking of two separately moveable switch arms.

It is also an object of this invention to provide improved means for securing the cover of a relay of the type disclosed herein to the associated base plate upon which the relay elements are mounted.

Other objects of the invention will be apparent hereinafter from the specification and from the recital of the appended claims, particularly when read in conjunction with the accompanying drawings.

Figure 5:
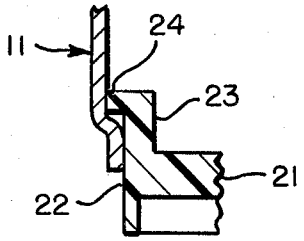
FIG. 5 is a fragmentary sectional view taken generally along the line 5—5 in FIG. 1 looking in the direction of the arrows.

Referring now to the drawings by numerals of reference, 11 denotes generally a hollow, rectangular, generally cup-shaped housing having a plane, closed upper end 12, spaced, parallel side walls 13 and 14, and spaced, parallel front and rear walls 15 and 16, respectively. Secured in and sealing the lower, open end of housing 11 is a rectangular base plate 21, which is made from a rigid, dielectric plastic material, or the like. Each corner of plate 21 is flatted off as at 22 (FIGS. 1 and 5) and has thereon an integral, vertical projection 23, and a tab or tongue 24 which projects horizontally from the upper end of each projection. Each tab 23 overlies a portion of housing 11 (FIG. 5) which is crimped at each corner thereof beneath the associated tab 24 to lock the lower edge of housing 11 against a flange 25 which surrounds plate 21 between its chamfered corners.

Secured at their lower edges to the upper or inside surface of base plate 21 by integral lugs 28 are the two legs 26 and 27 of a right-angular mounting bracket. The leg 26 of this bracket extends parallel to housing wall 16, and the other leg 27 extends parallel to the housing wall 13. Secured at one end flush against the inside surface of bracket leg 27 is the spool or bobbin 31 upon which is wound an armature coil 32. A metal stud 34, which extends coaxially through a dielectric sleeve 35 that is secured in the bore of spool 31, has a reduced-diameter neck portion 36 which extends through a central opening in the bracket leg 27. The neck portion 36 is coined or spun over as at 37 at the exterior of the leg, thereby to fix the spool 31 so that it projects from the left to the right in FIGS. 1 and 2 from the bracket leg 27, and parallel to the other leg 26 of the bracket.

Secured by spot welding or the like to the outside surface of bracket leg 26 adjacent its free end is the common base plate portion 41 of a bifurcated leaf spring. This spring has two, spaced parallel leg portions 42 and 43, which have outwardly curved or bowed portions 42' and 43', respectively, by means of which the spring legs are connected at their inner ends (upper ends in FIG. 1) to the common base plate portion 41. The two leg portions 42 and 43 of the leaf spring are similar in configuration, and extend approximately at right angles to the base portion 41 of the spring, and transversely across the outer or right hand end (FIGS. 1 and 2) of the spool 31. Remote from their curved portions 42' and 43' the legs 42 and 43 have secured to their inside surfaces the electrical contacts 44 and 45, respectively, which are circular in configuration. Adjacent their free ends the spring legs 42 and 43 have inclined portions 46 and 47, respectively, which support the contacts 44 and 45 in vertical registry and slightly offset relation to the plane, central portions of legs 42 and 43.

The vertically spaced contacts 44 and 45 register laterally with a pair of vertically spaced stationary contacts 51 and 52, respectively. The lower, stationary contact 52 is secured to an upstanding lug 53, which projects vertically from one side edge of a horizontal terminal plate 54, which is fastened intermediate its ends to the inner surface of the base plate 21 by a rivet 55. On its opposite side edge plate 54 has an integral, flat terminal or lug 57 (FIG. 3) which extends downwardly through a slot 58 (FIG. 1) in the base plate 21 to the exterior of the housing.

A second metal terminal plate 61 is secured intermediate ends by the rivet 60 on the upper surface of plate 21 adjacent the plate 54. Terminal plate 61 has at one end an upwardly projecting, generally dog-shaped lug portion 62, which projects vertically upwardly adjacent the lug 53 on plate 54, and which has a laterally offset portion 63 to which the contact 51 is secured in vertical registry with the contact 52. Adjacent the rivet 60 the plate 61 has an integral, generally flat terminal or lug 65, which projects downwardly through another slot 66 in the base plate 21 to the exterior housing.

Figure 1:
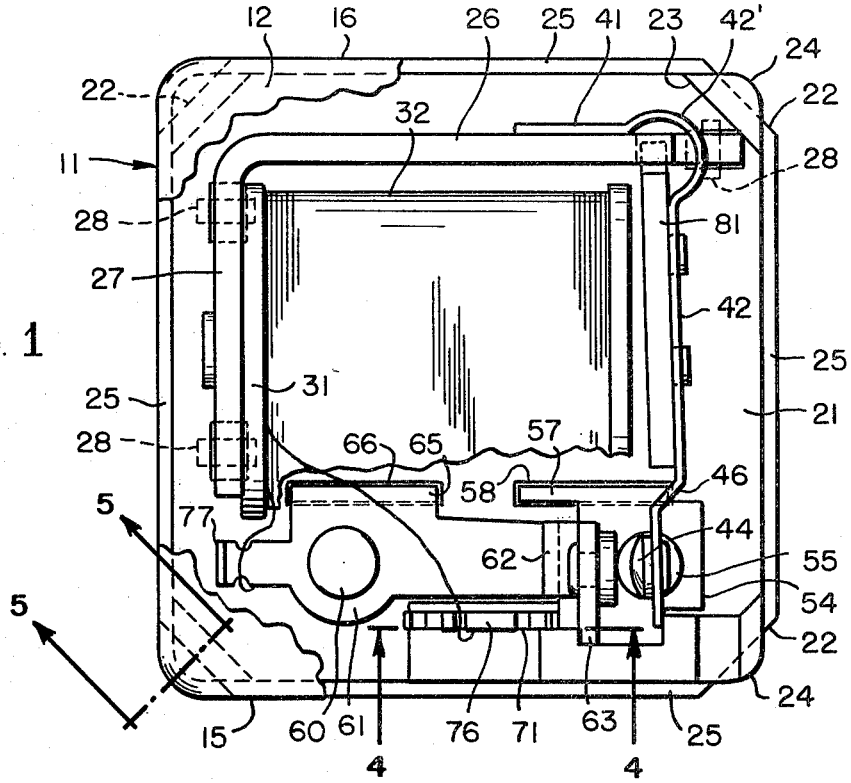
FIG. 1 is a plan view of a relay made according to one embodiment of this invention, but with portions of its cover and armature coil cut for purposes of illustration.
Figure 2:
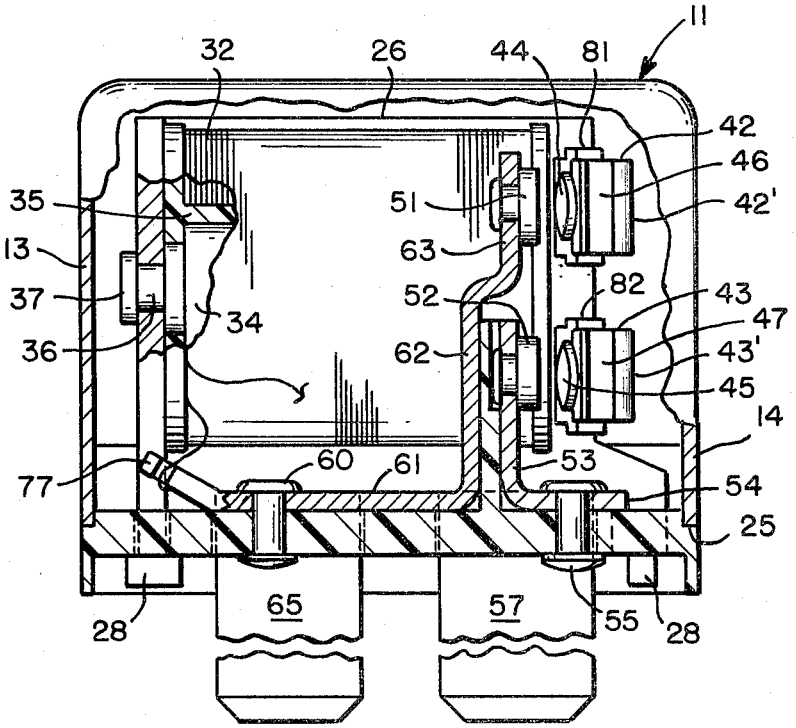
FIG. 2 is a fragmentary front elevational view of this relay, with portions thereof being cut or broken away and shown in section.

A third vertically disposed terminal plate 71 is staked intermediate its ends as at 72 (FIG. 5) in an opening 73 in the base plate 21 adjacent plate 54 and the outer or lower edge of plate 61 as shown in FIG. 1. The lower end of plate 71 projects downwardly through the slot 73 in base plate 21 in the form of an elongate, generally flat terminal 74. On its upper end plate 71 has a tang or lug 76 (FIGS. 1 and 5) to which is secured one end of the armature coil 32 which is wound on the bobbin 31. The other end of coil 32 is secured to a lug 77 which projects from the left end of the terminal plate 61 as shown in FIGS. 1 and 2.

Figure 3:
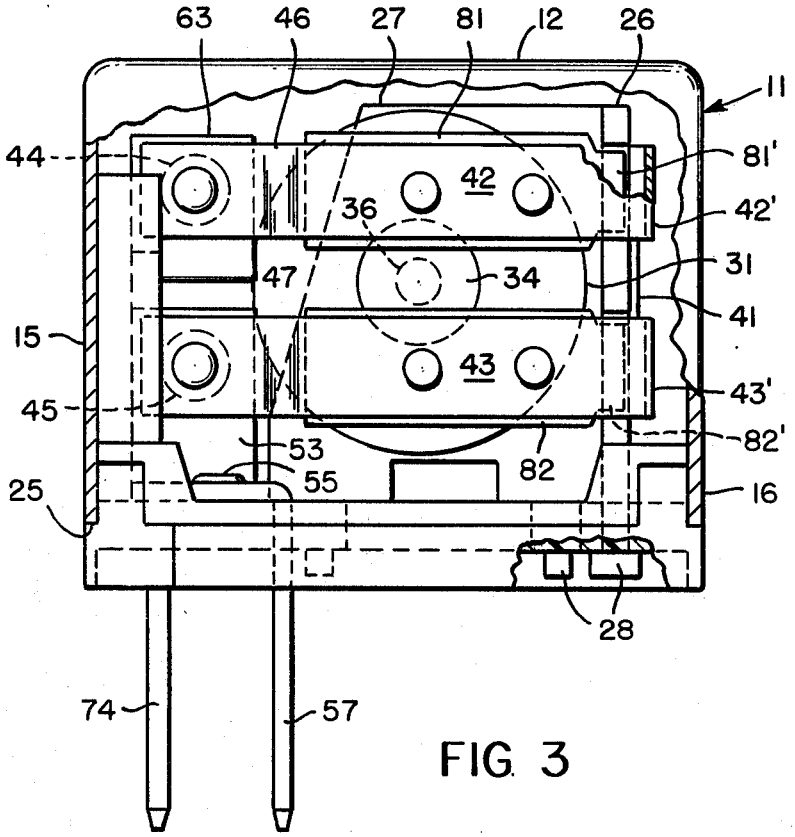
FIG. 3 is a side elevational view of this relay as seen when looking at its right side as shown in FIG. 2, portions thereof again being broken away and shown in section.
Figure 4:
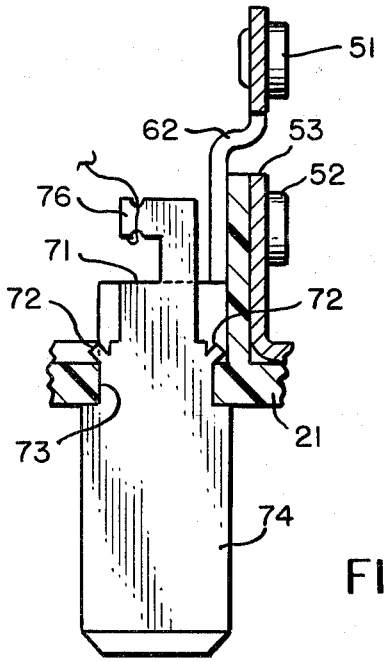
FIG. 4 is a fragmentary sectional view taken generally along the line 4—4 in FIG. 1 looking in the direction of the arrows.

In order to render the two springs legs 42 and 43 responsive to the magnetic field, which is generated upon the energization of coil 32, a pair of elongate, generally rectangular metallic armatures 81 and 82 are secured by staking or the like to the plane, inside surfaces of legs 42 and 43, respectively, intermediate their ends. At their rear or right hand ends as shown in FIG. 3, the plates 81 and 82 have narrow projections 81' and 82', respectively, which project into registering notches formed in the edge of the bracket leg 26 to provide supporting surfaces against which these ends of the armatures are free to pivot as noted hereinafter.

As thus far described, the two spring legs 42 and 43, which are interconnected at their rear ends by the integral plate portions 41, function as the movable switch arms of a single pole, single throw, double break switch; while the contacts 51 and 52, which are electrically connected, respectively, to the terminals 65 and 57, function as the stationary contacts for the switch. Consequently, when either of the contacts 44 or 45 is held by its associated spring leg 42 or 43, respectively, in engagement with either of the contacts 51 or 52, the circuit between the terminals 65 and 57 will be closed.

For example, assuming that opposite sides of a voltage supply are connected through a control switch (not illustrated) with the terminals 74 and 65, respectively, the armature winding 32 will be energized whenever the associated control switch is closed. When this occurs, the magnetic field set up at the right end of the bobbin 31 and its core 34 causes the metal armature plates 81 and 82 to be drawn suddenly toward the left in FIGS. 1 and 2, and into engagement, or nearly into engagement with, the right end of spool 31. This movement is imparted to the spring legs 42 and 43, which pivot clockwise in FIG. 1 into closed positions in which their respective contacts 44 and 45 engage the stationary contacts 51 and 52, respectively. A circuit is thus completed from one side of the power supply through the terminal 65, its leg 62, the contacts 51, 44 spring legs 42, the associated plate 41, the spring leg 43 and contacts 45 and 52 to plate 54 and its terminal 57.

The advantage of this construction is that both of the series-connected switch legs 42 and 43 must be in their fully closed positions in order to complete the above-noted circuit. If either contact 44 or 45 becomes disengaged or drops out from engagement with its associated contact 51 or 52, the circuit will open, notwithstanding the fact that one or the other of the contacts 44 or 45 might accidentally become stuck or welded closed against the associated stationary contact. This gives the effect of two relays in one, compact package. Moreover, this relay obviates the need for employing two separate, conventional relays to achieve the desired safety factor afforded by a double make or break circuit of the type described.

Still a further advantage of this construction is that, by securing the housing 11 to plate 21 only at its four corners, more space is made available on the plate 21 itself for mounting or riveting terminal plates and the like. Normally the housings are crimped to plate 21 along the sides thereof and thus use up valuable space which is used more efficiently with this invention.

While the present invention has been described in detail in connection with a single pole, single throw switch, it will be readily apparent to one skilled in the art that it is equally adapted to the production of a double pole, double-throw switch. Moreover, it will be apparent also that this application is intended to cover any such modifications as may fall within the scope of one skilled in the art or the appended claims.

What is claimed is:

1. A relay, comprising a housing having therein a pair of stationary electrical contacts, a relay coil in said housing, a bifurcated member fixed in said housing and having integral therewith a pair of spaced spring arms extending transversely across one end of said coil, an armature connected to each of said spring arms to effect movement thereof between first and second limit positions, and independently of each other, upon energization and deenergization, respectively, of said coil, and a pair of movable contacts connected to said spring arms for movement thereby, and independently of each other, to engage said stationary contacts when said spring arms are in one of said first and second limit positions, respectively, and to disengage said stationary contacts when said spring arms are in the other of said first and second limit positions.

2. A relay as defined in claim 1, wherein said member is made of electrically conductive material and electrically connects said movable contacts in series with each other.

3. A relay as defined in claim 2, wherein said member comprises a metal plate fixed on said housing adjacent one side of said coil, and said spring arms are integral with said plate and project therefrom in spaced, parallel relation to each other transversely across said one end of said coil.

4. A relay as defined in claim 3, wherein said armatures are secured to said spring arms to be supported thereby transversely across said one end of said coil, and in spaced relation to said one end when said coil is deenergized.

5. A relay as defined in claim 1, wherein said member supports said spring arms for pivotal movement about a common axis between said first and second limit positions thereof, and the axis of said coil extends at right angles to the common pivotal axis of said armatures.

6. A relay as defined in claim 1, wherein said coil is mounted in said housing on a rigid, dielectric plate which is secured in an opening in one end of said housing, a pair of terminal plates are fixed in spaced relation to the inside surface of said dielectric plate adjacent said coil, each of said terminal plates has thereon a first projection extending through an opening in said dielectric plate to the exterior of said housing, and a second projection within said housing to which one of said stationary contacts is secured, and said armatures and movable contacts are secured to said spring arms which are resiliently mounted in said housing to be pivoted by said armatures from said first to said second limit positions when said coil is energized.

7. A relay, comprising a support having thereon a pair of stationary electrical contacts, a relay coil mounted on said support, a pair of spaced, pivotal switch arms extending transversely across one end of said coil, each of said arms having a fixed end located adjacent one side of said coil, and a movable end carrying an electrical contact engageable with one of said stationary contacts, means mounting said fixed ends of said arms adjacent each other at said one side of said coil and for pivotal movement independently of each other about a common axis, and between first and second limit positions, respectively, to engage said movable contacts with, and to disengage them from, said stationary contacts, and a pair of separate armatures attached to said arms and operative in response to the energization of said coil to shift said switch arms from one to the other of said limit positions, said mounting means including resilient means operative normally to hold said arms in said one limit position and resiliently to resist movement thereof to said other limit positions.

8. A relay as defined in claim 7, including means electrically connecting said arms to each other.

9. A relay as defined in claim 7, wherein said mounting means comprises a spring metal plate fixed on said support adjacent said one side of said coil and having said arms integral with and projecting from one edge thereof in spaced, parallel relation across said one end of said coil, said movable contacts being fixed to the ends of said arms remote from said metal plate, and said armatures being fixed to said arms intermediate the ends thereof, and in confronting relation to said one end of said coil.

10. A relay as defined in claim 7, including a metal housing having an opening in one end thereof, said support comprising a generally rectangular dielectric plate mounted in the open end of said housing, and having its corners flatted off, and having between its corners laterally projecting flanges engaged by the edge of said housing around its open end, and said support having at each of its corners an integral lug which projects laterally beyond the flatted off portion of the corner, and said housing being crimped beneath said lugs and against the flat surfaces formed on said corners thereby to secure said support to said housing.

* * * * *